United States Patent [19]

Debski et al.

[11] 4,063,248

[45] Dec. 13, 1977

[54] MULTIPLE POLARIZATION ANTENNA ELEMENT

[75] Inventors: Thomas R. Debski, Bethpage; Joseph Gaudio, Coram, both of N.Y.

[73] Assignee: Sedco Systems, Incorporated, Melville, N.Y.

[21] Appl. No.: 676,387

[22] Filed: Apr. 12, 1976

[51] Int. Cl.[2] ..... H01Q 21/24; H01Q 21/28

[52] U.S. Cl. ..... 343/727; 343/778

[58] Field of Search ..... 343/727, 730, 786, 778, 343/854

[56] References Cited

U.S. PATENT DOCUMENTS

| | | | |
|---|---|---|---|
| 3,193,830 | 7/1965 | Prouencher | 343/729 |
| 3,205,499 | 9/1965 | Raburn | 343/730 |
| 3,623,112 | 11/1971 | Rupp et al. | 343/727 |
| 3,882,505 | 5/1975 | Mailloux | 343/727 |

*Primary Examiner*—E. Lieberman

*Attorney, Agent, or Firm*—Brumbaugh, Graves, Donohue & Raymond

[57] ABSTRACT

A multiple polarization antenna element comprises a combination of a waveguide radiator and a dipole radiator disposed across the waveguide aperture. The dipole radiator is orientated to radiate a polarization perpendicular to the radiation from the waveguide aperture. Independent means are provided for supplying wave energy signals to the waveguide and dipole radiators. The arrangement of the elements is such that both polarizations are radiated from substantially the same phase center.

8 Claims, 9 Drawing Figures

MULTIPLE POLARIZATION ANTENNA ELEMENT

BACKGROUND OF THE INVENTION

This invention relates to antenna elements for radiating multiple polarization, and particularly to such elements wherein the polarization may be selected by control of wave energy signals supplied to the element.

Multiple polarization antenna elements are usable in a variety of antenna systems. In some cases where a broad angular radiation pattern is desired such an element may be used as the antenna itself. The capability to radiate multiple selectible polarizations allows matching of the antenna element polarization characteristics to those of radiation signals, thereby providing a most efficent transfer of electromagnetic radiations into electrical signals. In other cases such antenna elements may be used to illuminate parabolic reflectors in order to form a narrow beam of radiated electromagnetic energy. In still other applications such antenna elements may be arranged in the form of an array antenna and their radiated signals combined in phase to form a concentrated beam of radiation.

Many multiple polarization antenna elements use radiation in orthogonal linear polarizations, with selected amplitudes and phases to form the desired polarization. It is well known in the art that any arbitrary polarization, including right or left hand circular polarization, and any orientation of linear or elliptical polarization may be achieved by combining orthogonal linear polarization signals with selected amplitude and phase. It is desirable in such multiple polarization antennas that the radiation pattern in each orthogonal polarization be substantially identical. It is well known that the radiation amplitude pattern characteristics of a dipole radiator in the E plane are similar to the H plane radiation characteristics of a waveguide radiator. Conversely the H plane pattern characteristics of a dipole radiator are similar to the E plane radiation characteristics of a waveguide radiator. The combination of a waveguide radiator and dipole radiator therefor provides well matched spacial amplitude radiation patterns of orthogonally polarized radiated signals. Because of the spatially matched amplitude radiation pattern, the combination of these elements therefore can provide an efficient multiple polarization radiating element with good polarization control over substantially the entire portion of space into which the element radiates.

Prior art elements for radiating multiple polarizations have included waveguide radiators with parasitic dipole radiators. In such an arrangement a waveguide radiator is used to radiate wave energy in a first polarization. A dipole radiator is arranged across the wave-guide aperture and is coupled to the signals radiated by the waveguide radiator and thereby caused to radiate an orthogonal polarization. The dipole radiator in this prior art antenna is not independently supplied with wave energy signals, but derives signals from the field created by the waveguide radiator. The dipole is therefore referred to as a "parasitic dipole". The amplitude and phase of energy radiated by the parasitic dipole element is dependent on its location and orientation in the aperture of the waveguide radiator and its radiation consequently has a fixed amplitude and phase with respect to the radiation from the waveguide radiator at any particular frequency. It is consequently not possible to change the radiated polarization of the combined element by variation of the amplitude or phase of the supplied signal.

Other prior art systems may have used dipole radiators in combination with waveguide radiators. In accordance with such prior art it has not been possible to locate the radiation phase center of the dipole radiator at the radiation phase center of the waveguide radiator because of potential interference of the structures with electromagnetic fields.

It is therefore an object of the present invention to provide an antenna element for radiating signals in multiple polarizations.

It is a further object of the present invention to provide such an antenna element wherein the polarization of the radiated signal is variable in accordance with the relative phase and amplitude of supplied energy wave signals.

It is a still further object of the present invention to provide such an antenna element wherein the radiated signals in each of orthogonal linear polarizations are radiated with the same phase center.

It is a still further object of the present invention to provide a multiple polarization array antenna system.

SUMMARY OF THE INVENTION

In accordance with the present invention there is provided a multiple polarization antennar element which includes a waveguide radiator for radiating supplied wave energy signals in a first selected polarization through an aperture, and a dipole radiator, disposed across the aperture in a plane perpendicular to the first selected polarization, for radiating supplied wave energy signals in a second perpendicular polarization. There are provided means for independently supplying wave energy signals with selected amplitude and phase to the waveguides and dipole radiators. Proper selection of the amplitude or phase of the supplied signals results in radiation of the signals with a selected polarization.

In a preferred embodiment of the invention, the dipole radiator comprises a pair of oppositely facing U-shaped conductive members, each connected to an E plane wall of the waveguide radiator. Signals are supplied to the dipole radiator by applying the signals across a gap between the U-shaped radiators. In order to provide minimum antenna element dimensions the waveguide radiator may be formed of ridge waveguide, in which case, the dipole would be disposed across the center of the waveguide aperture between the ridges.

A significant feature of the elements in accordance with the present invention is that they may be conveniently arranged to form a closely spaced array antenna. The broadband electrical characteristics of the dipole and waveguide radiators and small dimension of the antenna element enable the construction of a broadband, multiple polarization phased array antenna. In addition, the particular configuration of the U shaped dipole radiators is useful for supporting a dielectric sheet in front of the waveguide apertures to facilitate wide-angle impedance matching of the phased array antenna.

For a better understanding of the present invention, together with other and further objects, reference is made to the following description, taken in conjunction with the accompanying drawings, and its scope is pointed out in the appended claims.

DESCRIPTION OF THE EMBODIMENT OF FIG. 1

Figure 1:
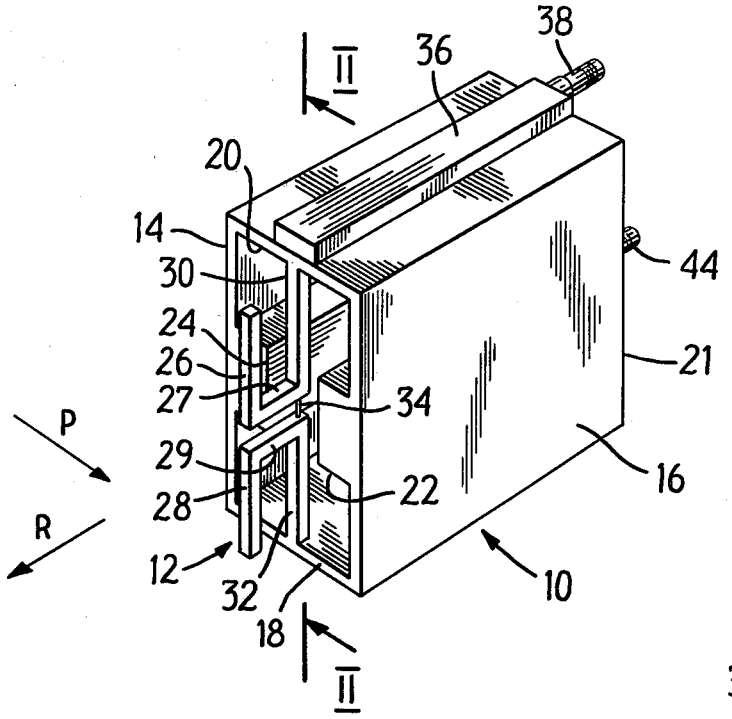
FIG. 1 is a perspective view of a multiple polarization antenna element in accordance with the present invention.
Figure 2A:
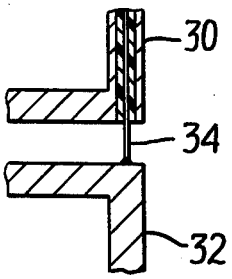
FIG. 2 is a cross sectional view of the antenna element of FIG. 1.
Figure 2:
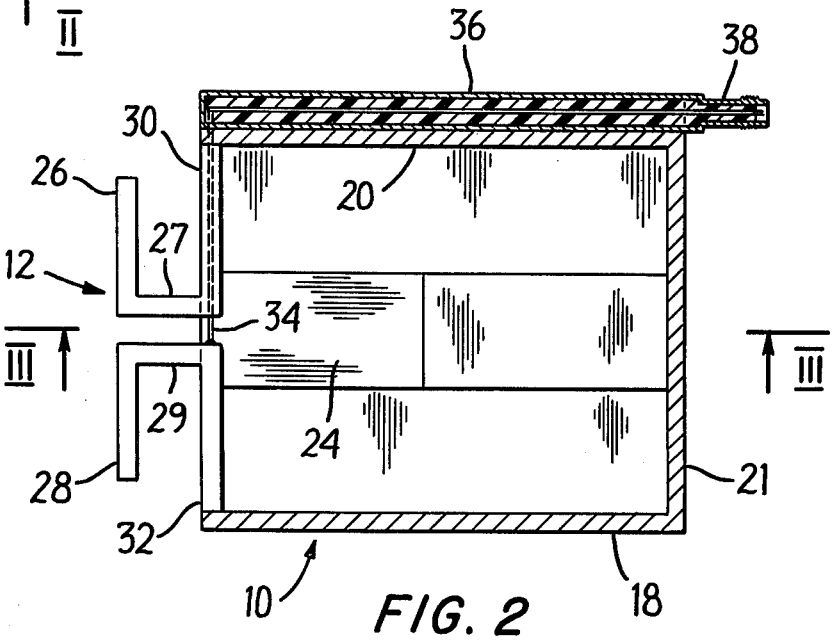
Figure 3:
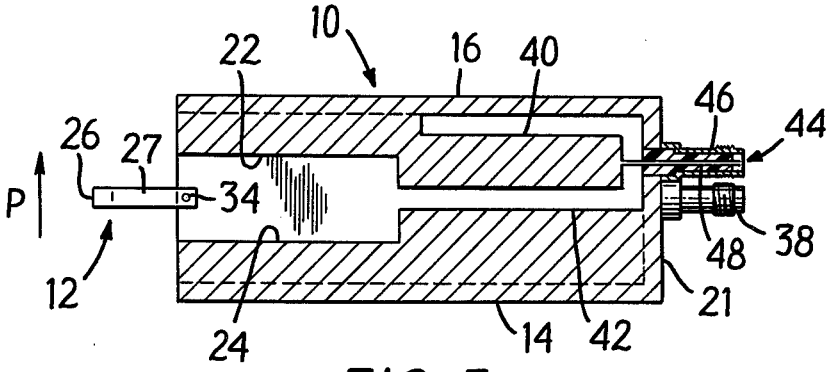
FIG. 3 is another cross sectional view of the antenna element of FIG. 1.

FIGS. 1 to 3 show an antenna element in accordance with the present invention. The element includes a waveguide radiator 10 and a dipole radiator 12, which is disposed across the aperture of waveguide radiator 10. Radiator 10 has a rectangular cross section which includes H plane walls 14 and 16 and E plane walls 18 and 20. Also provided within waveguide element 10 are ridges 22 and 24 which are attached to H plane walls 14 and 16. One end of waveguide radiator 10 is open to provide an aperture for the radiation of electromagnetic signals into space. The opposite end is closed by endplate 21, which can be seen in the cross sectional views of FIGS. 2 and 3. There is provided an endplate 21 a coaxial connector 44, which will be described in detail below. Wave energy signals provided to coaxial connector 44 will be radiated in a first selected polarization whose E-vector is in the direction indicated by the arrow P in FIGS. 1 and 3.

The internal configuration of waveguide radiator 10 is illustrated in the cross sectional view of FIG. 3. The longitudinal dimension of the waveguide radiator is approximattely one-half wavelength. Ridges 22 and 24 extend approximately a quarter wavelength from the aperture. Ridge 42, an extension of ridge 24 and conductively connected to H plane wall 14 and endplate 21, is stepped at approximately the midpoint to provide lower impedance in connection with ridge 40. Ridge 40, which is an extension of ridge 22 is electrically insulated from adjacent H plane wall 16 and endplate 21. The inner conductor 48 of coaxial connector 44 is electrically connected to ridge 40 adjacent to endplate 21. Outer conductor 46 of connector 44 is connected to endplate 21.

Insulated ridge 40 in connection with ridge 42 and endplate 21 in the configuration illustrated forms a coaxial to ridge waveguide transition. The insulated section of ridge 40 is approximately a quarter wavelength in length. The proximity of the coax to waveguide transition to the aperture of the ridge waveguide element may be advantageously used to provide broadband tuning of waveguide element 10. In particular the variation of impedance characteristics with frequency of waveguide radiator 10 may be used to counteract similar frequency variations of impedance of the coax to waveguide transition to provide a relatively wide band-width of radiator operation. It has been found that such radiators, designed for use in phased array antennas can be efficiently matched with a band-width of as much as 2 to 1 in frequency. The impedance matching of the waveguide radiator will depend to a large extent on the application of the antenna element. Those skilled in the art will recognize that the tuning techniques applicable to an element which is to be used by itself will be different than those applicable to an element which is to operate in an array environment. When the element is to be used in an array environment, the element tuning should be carried out under conditions which simulate the impedance of the element in connection with other operating elements, such as waveguide array simulator.

There is provided in the antenna element illustrated in FIGS. 1 through 3 a dipole radiator 12 which includes first and second dipole arms 26 and 28. Dipole arm 26 is connected by longitudinal support member 27 and transverse support member 30 to the E plane wall 20 of the waveguide radiator. Similarly dipole arm 28 is connected by support members 29 and 32 to E plane wall 18. The dipole members are disposed across the waveguide aperture in a plane perpendicular to the polarization of the signals radiated by the waveguide radiator and in a configuration to cause minimal interference with the radiation characteristics of the waveguide radiator. Wave energy signals are supplied to dipole radiator 12 by coaxial connector 38, which is connected to the dipole radiator by means of strip line 36 and a coaxial transmission line within support member 30. The center conductor of the coaxial transmission line within support 30 is connected to support 32 as illustrated in FIG. 2A. Consequently wave energy signals supplied to connector 38 are applied across the space between support members 30 and 32.

The structure of dipole radiator 12 may be advantageously used for impedance matching the dipole radiator over a broad range of frequencies. In addition to radiating members 26 and 28, whose impedance characteristics are known to those skilled in the art, and may be easily calculated, radiator 12 includes longitudinal members 27 and 29 which comprise a two-conductor transmission line interconnecting dipole arms 26 and 28 with the feed point at which wave energy signals are supplied to the radiator. By proper selection of the length and spacing of longitudinal members 27 and 29, and adjustment of the length of dipole arms 26 and 28, it is possible to use the impedance characteristics of the coaxial feed point to provide a broadband matching of the impedance characteristics of the dipole radiator. As in the case of the waveguide radiator 10, tuning of dipole radiator 12 should take into account the end objective use of the antenna element.

Figure 2B:
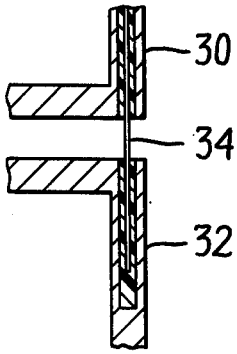

An alternate arrangement of providing wave energy signals from inner conductor 34 of the coaxial line within support member 30 is illustrated in FIG. 2B. In order to provide what appears to be a short circuit between inner conductor 34 and support member 32 at the point at which member 34 meets member 32, there is provided an extension of the coaxial line within support member 32, which is terminated by an open circuit approximately a quarter wavelength away from the desired short circuit point. Adjustment of the distance between the open circuit point and the point at which conductor 34 enters member 32 can provide an additional parameter for varying the impedance matching of dipole radiator Dipole radiator 12 is oriented to radiate wave energy signals in polarization which is perpendicular to radiation from waveguide radiator 10. In addition the orientation of dipole element 12 with respect to waveguide radiator 10 causes an approximate spatial match between the amplitude radiation characteristics of radiators 10 and 12. Waveguide radiator 10 radiates an amplitude pattern in the H plane, perpendicular to arrow P, which is approximately equal to the cosine of the radiation angle from the broadside direction, indicated by arrow R. The amplitude pattern of radiator 10 in the E plane, which is perpendicular to the H plane, is largely dependent on the ground plane within which the radiator is mounted and has approximately uniform amplitude distribution with angle from the broadside direction. The amplitude radiation pattern of dipole radiator 12 is complementary to that of waveguide radiator 10. The E plane pattern of dipole radiator 12 which has the same spacial orientation as the H plane pattern of waveguide radiator 10, has the same amplitude variation. The H plane pattern of dipole radiator 12 is in spacial orientation with and is similar in amplitude to the E plane pattern of waveguide radiator 10. Consequently in most regions of space into which radiators 10 and 12 radiate electromagnetic energy, the amplitude of radiation from each of the radiators is approximately equal, assuming equal input power to the radiators.

The element illustrated in FIGS. 1 through 3 may be caused to radiate signals in any desired polarization by variation of the amplitude and phase of the wave energy signals supplied to input connectors 38 and 44. If signals are only supplied to input connector 44 and no signals are supplied to connector 38 the element will radiate signals with a linear polarization in the direction indicated by arrow P. If signals are supplied only to connector 38 and no signals are supplied to connector 44 the element will radiate linear polarization with an orientation perpendicular to arrow P. If varying amplitudes of wave energy signals are supplied to both connectors 38 and 44 with a fixed phase relation so that the radiated wave energy signals from radiator 10 and radiator 12 are in phase, or 180° out of phase, the element will radiate linear polarization with a polarization orientation dependent upon the relative amplitude of the signals supplied to inputs 38 and 44. By supplying wave energy signals with equal amplitude and positive or negative quadrature phase to connectors 38 and 44 the element may be caused to radiate either right-hand or left-hand circular polarization. Those skilled in the art will recognize that any arbitrary polarization, including linear polarization of any orientation, circular polarization, or elliptical polarization may be achieved by variation of the phase and amplitude of the signals suppled to connectors 38 and 44.

Figure 4:
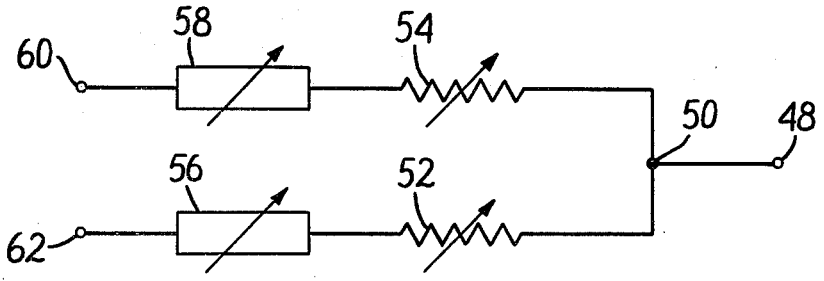
FIG. 4 is a schematic diagram of a circuit usable to supply wave energy signals to the FIG. 1 antenna element.

Shown in FIG. 4 is a circuit which is usable to provide wave energy signals with variable amplitude and phase to connectors 38 and 44 of the antenna element shown in FIG. 1. Wave energy signals supplied to input terminal 48 are divided into two equal energy signals by power divider 50. Variable attenuators 52 and 54 may be adjusted so that the signals in each of the two channels have the desired amplitude. Variable phase shifters 56 and 58 may similarly be adjusted to achieve the desired phase relation between the signals in each of the two channels. The output signals at terminals 60 and 62, which may be supplied to connectors 38 and 44 of the antenna element, will therefore have any desired relative amplitude and phase. Consequently, appropriate adjustment of variable antenuators 52 and 54 and variable phase shifters 56 and 58 will result in signals suitable to cause the antenna element of FIG. 1 to radiate any desired polarization.

Figure 5:
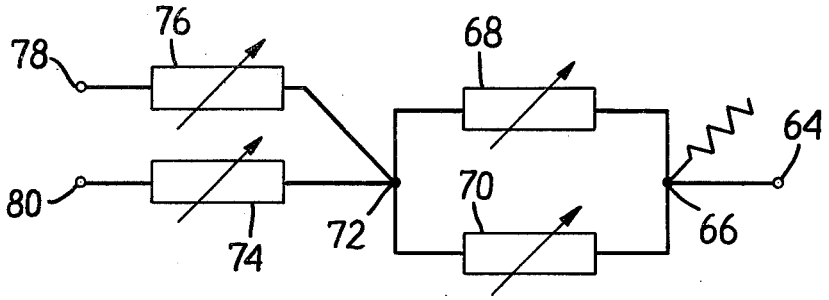
FIG. 5 is a schematic diagram of an alternate circuit usable to supply wave energy signals to the FIG. 1 antenna element.

The use of variable attenuators in the FIG. 4 circuit causes an unnecessary signal loss in achieving the desired amplitude and phase relation between the signals applied to connectors 38 and 44. Illustrated in FIG. 5 is a schematic diagram of an alternate circuit, usable to adjust the amplitude and phase of signals to be supplied to the antenna element without suffering a loss of signal energy, except for the incidental loss with the circuit components. The circuit illustrated in FIG. 5 has a hybrid power divider 66 connected to input terminal 64. The colinear output ports of hybrid 66 are connected to variable phase shifters 68 and 70. The outputs of phase shifters 68 and 70 are connected to the colinear ports of a second hybrid 72. The sum and difference ports of hybrid 72 are connected to a second set of variable phase shifters 74 and 76 and then to output terminals 78 and 80. The difference port of hybrid 66 is terminated in a matched resistive load. Those skilled in the art will recognize the phase shifters 68 and 70, in conjunction with hybrids 66 and 72 form a variable lossless power divider. If phase shifters 68 and 70 have the same phase the entire signals supplied at input 64 will be supplied to output 80, except for incidential loss in the circuit components. If phase shifter 68 is set to have a phase which is 180° different from the phase shifter 70 the entire signal supplied to input port 64 will be supplied to output port 78. Intermediate values for phase shifters 68 and 70 will result in intermediate division of power between output terminals 78 and 80.

Phase shifters 74 and 76 may be used to cause the usable signals at terminals 78 and 80 to have the desired phase relation. In addition to setting these phase shifters for the desired phase difference in the radiated signal, the phase shifters may be used to compensate for relative phase differences in the two signals which result from the variable power divider constituting hybrids 66 and 72 with phase shifters 68 and 70.

Figure 6:
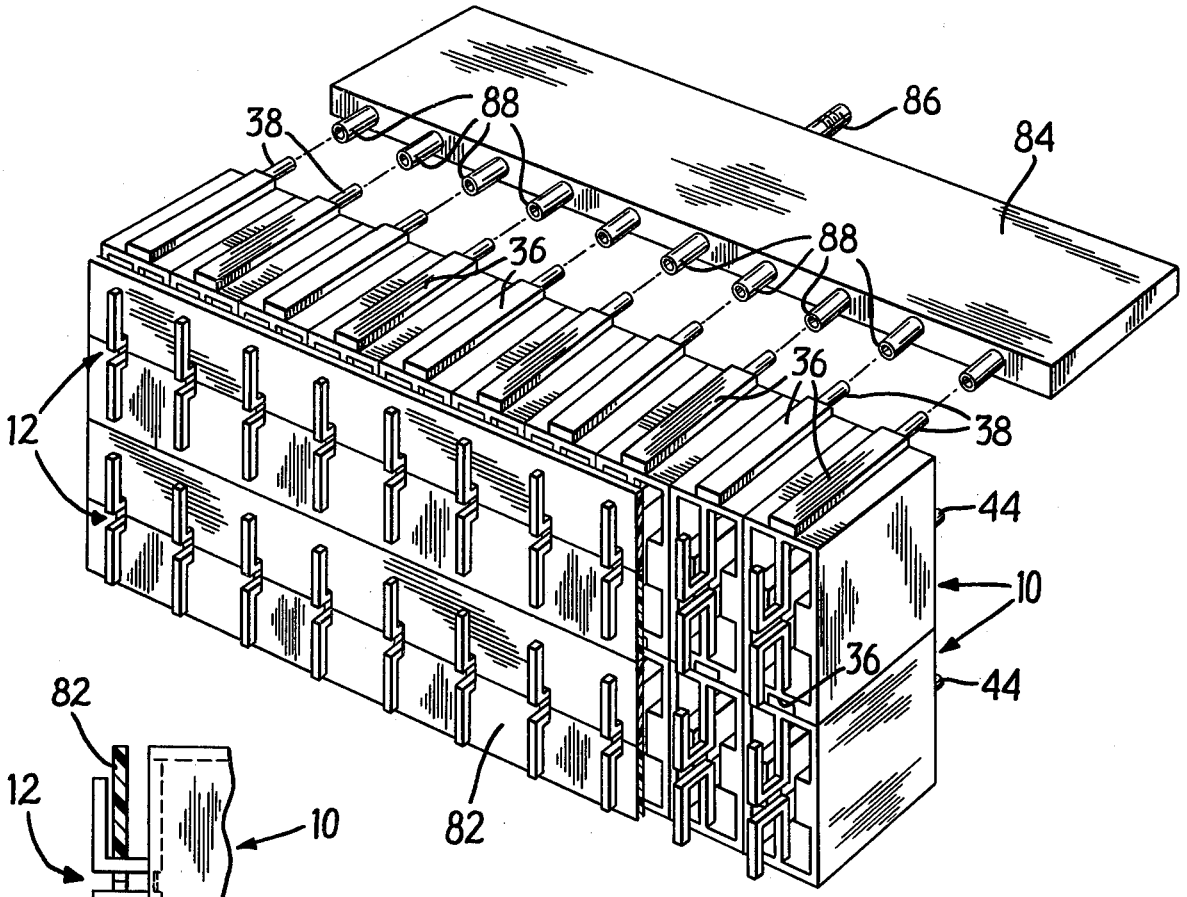
FIG. 6 is a perspective view of an array antenna in accordance with the present invention.

FIG. 6 illustrates an array antenna using the antenna elements of FIGS. 1 to 3. These elements are advantageously used in a variable polarization array antenna because of the small interelement spacing which is possible, and permits operation of the array antenna over a wide range of frequencies, while enabling phase scanning of the array to wide angles. Those skilled in the art will recognize that it is advantageous to arrange the elements in rows with adjacent H plane walls of the waveguide radiators in the plane of the array in which the largest scanning angle is desired. Thus there can be obtained very close elements spacing, in the order of a half wavelength at the highest operating frequency.

Another advantage of using the element of FIG. 1 to 3 in a phased array antenna is that the dipole and waveguide radiators each have the same virtual phase center of radiation. As a result it is not necessary to adjust the phase between the signals supplied to the waveguide and dipole radiators in accordance with the radiation angle of the array antenna. The phase between these signals may be fixed in accordance with the desired polarization and the phase between the signals supplied to the elements of the array may be adjusted in accordance with the desired angle of array radiation.

In addition to the elements comprising radiators 10 and 12 used in the array of FIG. 6, there is provided a power divider 84 which is useful in supplying wave energy signals to the elements of the array from a common signal source. Power divider 84 has an input 86 and a plurality of outputs 88. Each of outputs 88 is connected by a transmission line of appropriate length to one of connectors 38 or 44 on the elements of the array. When it is desired that the antenna be capable of electronic scanning or polarization control, there may be provided amplitude and phase control circuits, such as shown in FIG. 4 or 5 between outputs 88 of power divider 84 and connectors 38 and 44 of the array elements. These circuits may provide phase control for antenna beam steering as well as for polarization control.

Figure 6A:
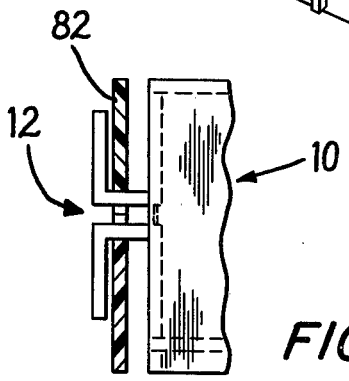

Another advantage of the present element design for use in an array antenna is that the protruding dipole radiator 12 may be conveniently used to support an impedance matching dielectric sheet, such as dielectric sheet 82 shown in FIGS. 6 and 6A. It is well known in the art that such a dielectric sheet arranged a short distance in front of the element apertures can provide wide angle impedance matching for a phased array antenna.

While the characteristics and operation of the present invention have been described with particular reference to a transmitting antenna, those skilled in the art will recognize that such antennas as have been described are reciprocal in nature. It is therefore intended that such descriptions should apply with equal force to antennas which are designed or used for receiving wave energy signals and that the appended claims should apply with equal force to such receiving antenna elements or phased arrays.

While there have been described what are believed to be the preferred embodiments of the present invention, those skilled in the art will recognize that other and further modifications may be had thereto without departing from the true spirit and scope of the invention, and it is intended to cover all such embodiments as fall within the true scope of the invention.

We claim:

1. An array antenna comprising: a plurality of waveguide radiators each having an aperture and first and second E-plane walls, said radiators being arranged in a predetermined pattern to radiate supplied wave energy signals with a first selected polarization;

a plurality of dipole radiators, each comprising first and second self-supporting conductive dipole members, each of said dipole members including an exposed transverse conductive support member connected to the center of one of said E-plane walls and extending across one of said waveguide apertures perpendicular to said selected polarization, a conductive longitudinal support member projecting outwardly from said aperture, and a transverse conductive dipole arm, supported by said support members, arranged parallel to said transverse support member and spaced a selected distance from said aperture, said dipole members being spaced apart and electrically insulated from each other at the center of each aperture, each of said dipole radiators having a coaxial transmission line for supplying wave energy signals, said transmission line extending through said transverse support of said first dipole member and having an outer conductor coupled to said transverse support member of said first dipole member and an inner conductor coupled to said transverse support member of said second dipole member;

and means for supplying wave energy signals to each of said waveguide and dipole rediators at selected amplitude and phase, the wave energy signals supplied to each of said dipole elements having a selected amplitude and phase with respect to the wave energy signals supplied to each of said waveguide elments, said selected amplitude and phase being the same for all elements;

whereby, when said signals are supplied, said array radiates wave energy signals in a polarization selected in accordance with the relative amplitude and phase of the signals supplied to said waveguide and dipole radiators.

2. An array antenna as specified in claim 1 wherein said means for supplying wave energy signals includes means for varying said selected amplitude and phase thereby to vary said polarization.

3. An array antenna as specified in claim 2 wherein said means for supplying wave energy signals includes means for varying the phase of the wave energy signals supplied to the elements of the array, thereby to vary the angle at which said wave energy signals are radiated.

4. an array antenna as specified in claim 1 wherein said dipole members project from said waveguide apertures and wherein there is provided a sheet of dielectric material in front of said waveguide apertures and supported by said dipole radiators.

5. A multiple polarization antenne element comprising:

a waveguide radiator having first and second E-plane walls for radiating wave energy signals in a first selected polarization through an aperture;

a dipole radiator, comprising first and second self-supporting conductive dipole members, each of said dipole members including an exposed transverse conductive support member connected to the center of one of said E-plane walls at said aperture and extending across said aperture perpendicular to said first selected polarization, a conductive longitudinal support member projecting outwardly from said aperture, and a transverse conductive dipole arm, supported by said support members, arranged parallel to said transverse support member and spaced a selected distance from said aperture, said dipole members being spaced apart and electrically insulated from each other at the center of said aperture;

a coaxial transmission line extending through said transverse support member of said first dipole member, for supplying wave energy signals to said dipole radiator, said transmission line having an outer conductor coupled to said transverse support member of said first dipole member and an inner conductor coupled to said transverse support member of said second dipole member;

and means for independtly supplying wave energy signals to said waveguide radiator.

6. An antenna element as specified in claim 5 wherein said means for supplying wave energy signals includes an endwall coaxial to waveguide transition on said waveguide radiator.

7. An antenna element as specified in claim 5 wherein said waveguide radiator is a ridge waveguide radiator.

8. An antenna element as specified in claim 7 wherein said means for supplying wave energy signals includes an endwall coax to waveguide transition on said waveguide radiator.

* * * * *